US006470154B1

(12) United States Patent
Shinohara

(10) Patent No.: US 6,470,154 B1
(45) **Date of Patent: *Oct. 22, 2002**

(54) COLOR IMAGE FORMING APPARATUS HAVING CLEANING METHOD FOR CHROMATIC AND MONO-CHROMATIC MODES

(75) Inventor: Hayato Shinohara, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/995,898

(22) Filed: Dec. 22, 1997

(30) Foreign Application Priority Data

Dec. 26, 1996 (JP) ..... 8-357177

(51) Int. Cl.[7] ..... G03G 15/00
(52) U.S. Cl. ..... 399/71; 399/101
(58) Field of Search ..... 399/71, 101, 343, 399/344

(56) References Cited

U.S. PATENT DOCUMENTS

| | | | | |
|---|---|---|---|---|
| 4,655,581 | * | 4/1987 | Yamada | 399/71 |
| 5,303,009 | * | 4/1994 | Nishizawa | 399/71 |
| 5,357,318 | * | 10/1994 | Haneda et al. | 399/148 |
| 5,845,174 | * | 12/1998 | Yasui et al. | 399/101 |

FOREIGN PATENT DOCUMENTS

| | | | |
|---|---|---|---|
| EP | 0 488 147 | | 6/1992 |
| JP | 63-088572 | | 4/1988 |
| JP | 04-67188 | * | 3/1992 |
| JP | 05-80676 | * | 4/1993 |
| JP | 05-313457 | * | 11/1993 |
| JP | 07-168494 | * | 7/1995 |
| JP | 08-334953 | | 12/1996 |
| JP | 09-258628 | | 10/1997 |

* cited by examiner

*Primary Examiner*—Robert Beatty
(74) *Attorney, Agent, or Firm*—Fitzpatrick, Cella, Harper & Scinto

(57) ABSTRACT

A color image forming apparatus for forming images in a mono-chromatic and full-color mode on an image bearing member by an electrophotographic system controls a cleaning device to operate for a time period according to a specific weighting factor corresponding to whether the image forming apparatus is in the mono-chromatic or full-color mode. In this manner, excess operating time of the cleaning device is eliminated to thereby enable the image forming speed to be improved. The image bearing member is an intermediate transfer member.

17 Claims, 8 Drawing Sheets

K K K K K K K
/TOP
/VDO
2nd TRANSFER TIMING
CLEANING BRUSH TIMING
ONE ROTATION + α

Y M C K Y M C K
/TOP
/VDO
2nd TRANSFER TIMING
CLEANING BRUSH TIMING
THREE ROTATIONS + α

COLOR IMAGE FORMING APPARATUS HAVING CLEANING METHOD FOR CHROMATIC AND MONO-CHROMATIC MODES

BACKGROUND OF THE INVENTION

1. Field of the Invention

This invention relates to a color image forming apparatus and method, and particularly to a color image forming apparatus and method of the electrophotographic type used as a copying apparatus or a printer.

2. Related Background Art

Heretofore, a color image forming apparatus having an intermediate transfer member has not made the cleaning time for the intermediate transfer member variably controllable by image forming conditions, but has supposed the worst case thereof and determined the cleaning time, and has executed cleaning in accordance with the determination. Particularly, in a printer which permits the mixed presence of color modes, i.e., the mixed presence of full color mode printing and monochromatic mode printing in the middle of continuous printing, the color condition commanded by a host computer for controlling the printer is indefinite. So, as regards the amount of cleaning of the intermediate transfer member, the maximum number of prints in the continuous printing by the full color mode is naturally supposed as the worst case, and also in the color mode and the number of prints, the effect of cleaning is reliably displayed to thereby secure the quality of the next printing.

However, in the printer according to the prior art which permits the mixed presence of the full color mode and the monochromatic mode in the middle of continuous printing and supposes the worst case to thereby control the cleaning time, it is necessary for an operator to wait for the cleaning time determined in the worst case until the next printing whenever cleaning is executed even in the middle of monochromatic printing. Also to the printer, realistic life taking the conditions of actual use into account cannot be set and in the choice of parts, it is necessary to excessively set the required life period. Also, depending on the cleaning method, noise is created and even during the printing by the monochromatic mode which originally could be short, noise is created for a long cleaning time corresponding to the printing time by the full color mode.

SUMMARY OF THE INVENTION

It is the object of the present invention to provide a color image forming apparatus and method of the electrophotographic type which can determine the cleaning time with the conditions of actual use of monochromatic mode printing and full color mode printing taken into account.

The present invention which achieves the above object relates to image forming apparatus for forming the images in the monochromatic mode and the full color mode by an electro-photographic system. The apparatus has means for forming a toner image on an image bearing member in a predetermined color mode, transfer means for transferring the toner image to a transfer member, cleaning means for removing any toner remaining on the image bearing member after the transfer, color mode detecting means for detecting the kind of a selected color mode, and determining means for determining the time for the cleaning means to clean the image bearing member on the basis of the detected kind of the color mode. The determining means sets the execution time of the cleaning means shorter for the monochromatic mode than for the color mode.

Also, the present invention relates to a color image forming method of forming the images of the monochromatic mode and the full color mode on an image bearing member by the electro-photographic system. The method has the step of forming a toner image on the image bearing member in a predetermined color mode, the transferring step of transferring the toner image to a transfer member, the cleaning step of removing any toner remaining on the image bearing member after the transfer, the color mode detecting step of detecting the kind of the selected color mode, and the determining step of determining the time for the cleaning means to clean the image bearing member on the basis of the detected kind of the color mode. The determining step sets the execution time of the cleaning means shorter for the monochromatic mode than for the full color mode.

DESCRIPTION OF THE PREFERRED EMBODIMENTS

Figure 1:
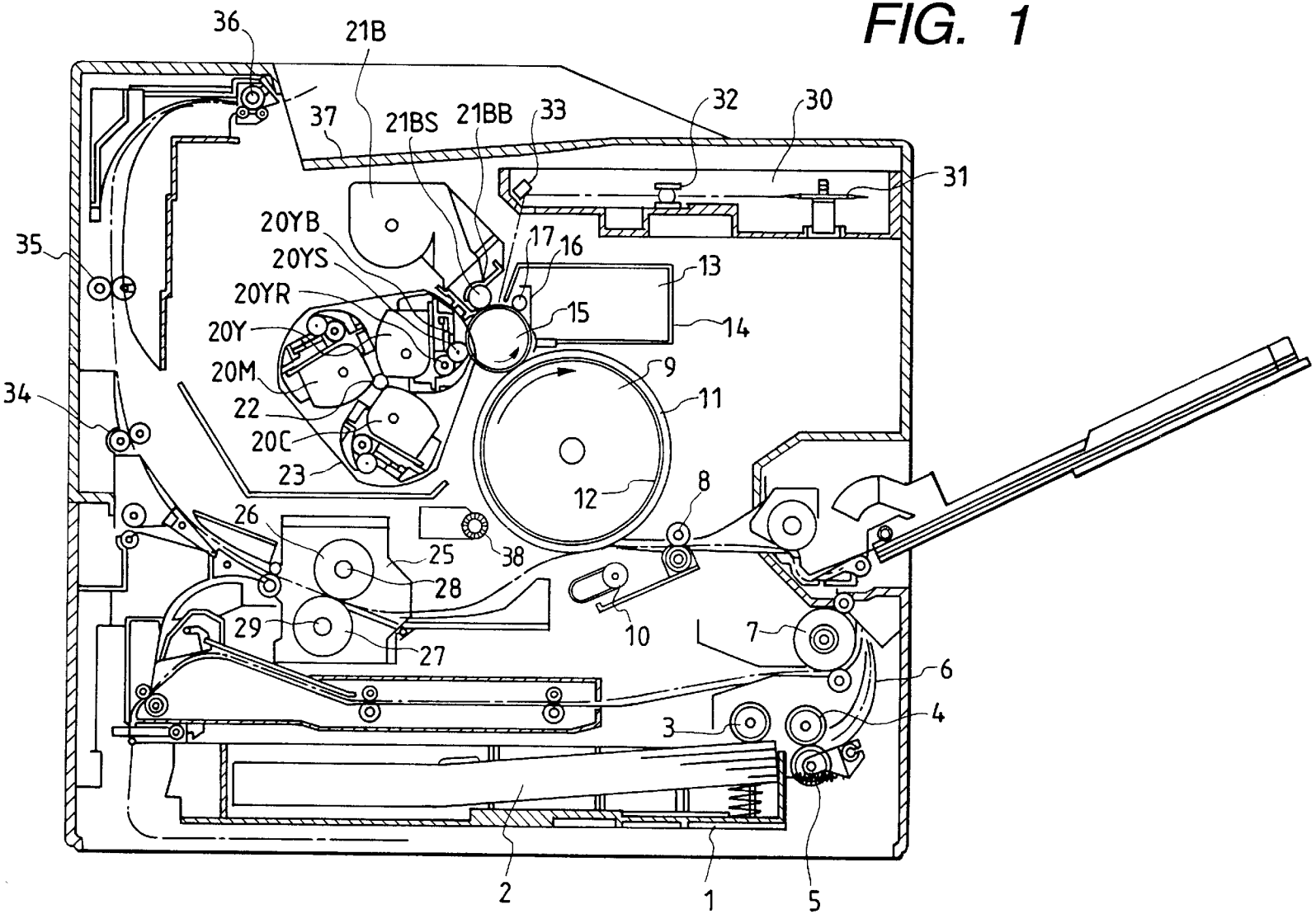
FIG. 1 shows the general construction of an image forming apparatus according to an embodiment of the present invention.

An image forming apparatus according to an embodiment of the present invention will hereinafter be described with reference to FIG. 1.

The image forming apparatus of FIG. 1 comprises a color laser printer in which color images developed by an image forming portion having a construction as will hereinafter be described and transferred to an intermediate transfer member 11 are further transferred to a transfer material 2 fed from a feeding portion 1 to thereby form a color image. This transfer material 2 is conveyed to a fixating portion 25 to thereby fixate the color image on the transfer material 2, which is then discharged to a discharging portion 37 on the upper surface of the printer body by a discharge roller. The image forming portion comprises a fixed black developing device and three rotatable color developing devices which are individually removably mountable with respect to the printer body.

As regards the exposure to the image forming portion, when an image signal is imparted from a scanner portion 30 to a laser diode, this laser diode applies image light corresponding to the image signal to a polygon mirror 31. Design is made such that the surface of a photosensitive drum 15 rotated at a constant speed is selectively exposed to the image light reflected by the polygon mirror 31 via an imaging lens 32 and a reflecting mirror 33.

The construction of each portion of the image forming portion will hereinafter be described.

(1) Image Bearing Member Unit

A drum unit 13 is integrally comprised of the photosensitive drum 15 and the container 14 of a cleaning device serving also as the holder of the photosensitive drum 15, and the drum unit 13 is removably mountably supported with respect to the printer body and is easily interchangeable in accordance with the life of the photosensitive drum 15. The photosensitive drum 15 is formed by applying an organic photoconductive material layer to the outside of an aluminum cylinder having a diameter t, and is rotatably supported by the container 14 of the cleaning device serving also as the holder of the photosensitive drum 15. A cleaner blade 16 and primary charging means 17 are disposed on the periphery of the photosensitive drum 15. Also, the photosensitive drum 15 is rotated counter-clockwisely as viewed in FIG. 1 by the driving of a drive motor provided rearwardly in conformity with the image forming operation.

(2) Charging Means

Charging means 17 is of the contact charging type, and an electrically conductive roller is brought into contact with the peripheral surface of the photosensitive drum 15 and a voltage is applied to the electrically conductive roller to thereby uniformly charge the peripheral surface of the photosensitive drum 15.

(3) Cleaning Device for the Photosensitive Drum 15

The cleaner blade 16 removes any toner remaining on the peripheral surface of the photosensitive drum 15 after the toner visualized on the photosensitive drum 15 by developing means has been transferred to an intermediate transfer member 9. The waste toner removed by the cleaner blade 16 is stored in the container 14. The quantity of the waste toner stored in the container 14 does not usually fill the container 14 earlier than the life of the photosensitive drum 15, and accordingly the container 14 is integrally interchanged during the interchange of the photosensitive drum 15. The cleaning of the photosensitive drum 15 by this cleaner blade 16 is effected at all times.

(4) Developing Means

Developing means is comprised of three rotatable developing devices 20Y, 20M and 20C and a black developing device 21B enabling the development of yellow, magenta, cyan and black colors to be accomplished in order to visualize latent images formed on the peripheral surface of the photosensitive drum 15.

The black developing device 21B is a fixed developing device, and a sleeve 21BS is disposed at a location opposed to the photosensitive drum 15 with a minute interval with respect to the photosensitive drum 15 and forms a visible image by a black toner on the photosensitive drum 15. The black developing device 21B feeds the toner in a container to the sleeve 21BS by a feeding mechanism, and applies a thin layer of toner to the outer periphery of the sleeve 21BS rotated clockwisely by an applying blade 21BS urged against the outer periphery of the sleeve 21BS and imparts charges to (frictionally charges) the toner. Also, by applying a developing bias to the sleeve 21BS, it effects toner development on the photosensitive drum 15 in conformity with the latent image.

The three rotatable developing devices 20Y, 20M and 20C are removably held on a developing rotary 23 rotatable about a shaft 22 to be rotatively moved about the shaft 22 while being held on the developing rotary 23 upon image fortion, and predetermined one of the developing devices is stopped at a position opposed to the photosensitive drum 15. Further, the sleeve is positioned so as to be opposed to the photosensitive drum 15 with a minute interval therebetween, and then a visible image is formed on the peripheral surface of the photosensitive drum 15. During the formation of a color image, the developing rotary 23 effects one full rotation for each one full rotation of the intermediate transfer member 9, and the developing process is executed in the order of the yellow developing device 20Y, the magenta developing device 20M, the cyan developing device 20C and the black developing device 21B. Thus, the intermediate transfer member 9 effects four full rotations, whereby visual images by yellow, magenta to form cyan and black toners are successively, so that a full color visible image is formed on the intermediate transfer member 9.

In FIG. 1, there is shown a state in which the yellow developing device 20Y is positioned and stationary at the position opposed to the photosensitive drum 15. The yellow developing device 20Y feeds the toner in the container to an applying roller 20YR by the feeding mechanism, and applies a thin layer of toner to the peripheral surface of the sleeve 20YS rotated clockwisely by the applying roller 20YR rotated clockwisely and a blade 20YB urged against the peripheral surface of the sleeve 20YS, and imparts charges to (frictionally charges) the toner.

By applying a developing bias to the sleeve 20YS opposed to the photosensitive drum 15 on which a latent image has been formed, toner development is effected on the photosensitive drum 15 in conformity with the latent image. For the magenta developing device 20M and the cyan developing device 20C, toner development is effected by a construction and operation similar to what has been described above.

Also, each of the sleeves of the rotatable developing devices 20Y, 20M and 20C is connected to a high voltage source for each color development and a driving mechanism provided in the printer body when each developing device is rotatively moved to the developing position, and a voltage is selectively applied to the sleeve in each color development and the driving mechanism is connected to the sleeve.

(5) Intermediate Transfer Member

The intermediate transfer member 9 (image bearing member) is clockwisely rotated to receive four times of transfer from the photosensitive drum 15 during the color image forming operation, and cooperates with a transfer roller 10 to hold and to convey the transfer material 2 to thereby transfer the respective color toner images on the intermediate transfer member 9 onto the transfer material 2 at a time. The intermediate transfer member 9 is of such structure that the outer periphery of an aluminum cylinder 12 having a diameter of 180 mm is covered with an elastic layer 11 of medium resistance sponge or medium resistance rubber or the like. The intermediate transfer member 9 is rotatably supported and receives a drive force from a gear (not shown) integrally fixed to the printer body to be rotated.

(6) Cleaning Means for the Intermediate

Transfer Member 9

Cleaning means 38 removes any toner remaining on the peripheral surface of the intermediate transfer member 9 after each color toner image on the intermediate transfer member 9 has been transferred onto the transfer material 2.

Figure 2:
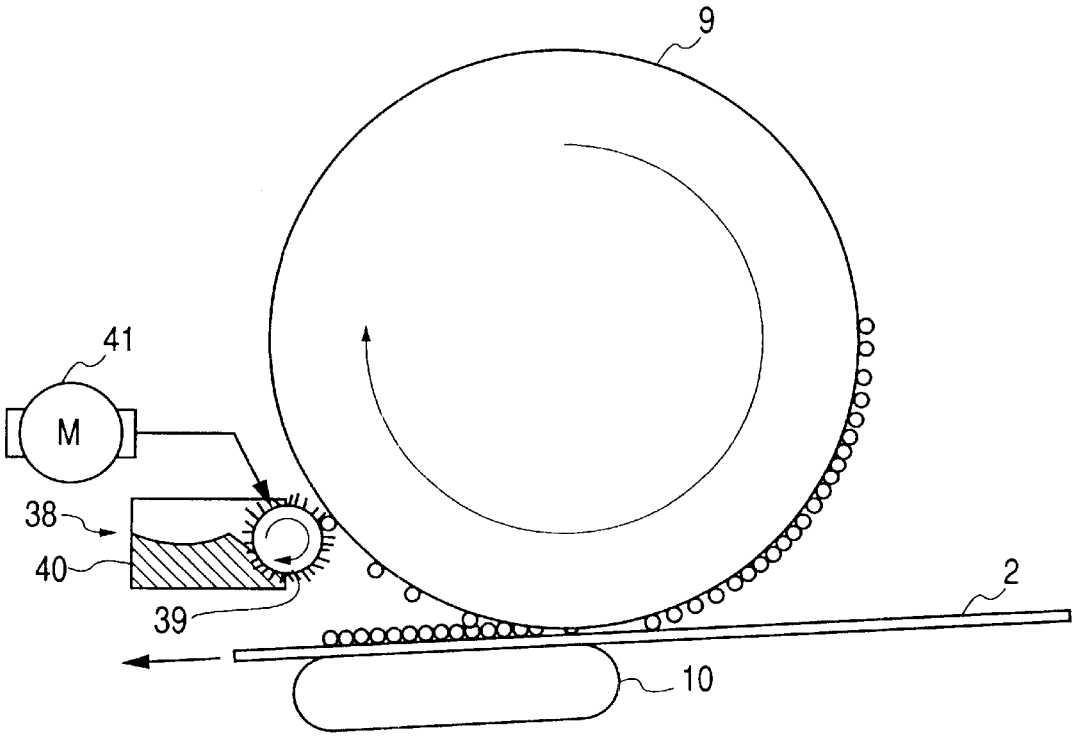
FIG. 2 is an illustration of cleaning means in the image forming apparatus of FIG. 1.

Referring to FIG. 2 which is a detailed illustration of the cleaning means 38 in the image forming apparatus of FIG. 1, the transfer material 2 is conveyed while being urged against the intermediate transfer member 9 by a transfer belt 10. As the result, the primary transferred image on the intermediate transfer member 9 is secondarily transferred onto the transfer material 2 on the transfer belt 10.

The cleaning means 38 comprises a cleaning brush 39 bearing against the intermediate transfer member 9 and scraping off the untransferred toner on the intermediate transfer member 9 after the secondary transfer, and a waste toner tank 40 for containing therein the waste toner scraped off. The cleaning brush 39 is connected to a motor 41 and is clockwisely rotatively driven by this motor 41. The cleaning brush 39 is designed to bear against or be spaced apart from the peripheral surface of the intermediate transfer member 9 by a mechanism (not shown). The timing of the bearing and being spaced apart is the same timing as the driving of the cleaning brush and is controlled by a mechanical control CPU 302 which will be described later.

(7) Sheet Feeding Portion

The sheet feeding portion feeds the transfer material 2 to the image forming portion, and is comprised chiefly of a cassette 1 containing a plurality of transfer materials 2 therein, a sheet feeding roller 3, a feeding roller 4, a retard roller 5 for preventing multiplex feeding, a sheet feeding guide 6 and a register roller 8. During image formation, the sheet feeding roller 3 is rotatively driven in conformity with the image forming operation and separates and feeds the transfer materials 2 in the cassette 1 one by one. The transfer material 2 is guided by the sheet feeding guide 6 and comes to the register roller 8 via a conveying roller 7. The register roller 8 performs the non-rotating operation of causing the transfer material 2 to stand by during image formation and the rotating operation of conveying the transfer material 2 toward the intermediate transfer member 9 at a predetermined sequence, so that the image and the transfer material 2 during the transfer process are aligned which is the next step.

(8) Transfer Portion

The transfer portion comprises a pivotable transfer belt 10. The transfer belt 10 is of such structure that a metallic shaft is wrapped by a medium resistance foamed elastic material, and is vertically pivotable and is connected to a driving mechanism. When toner images of four colors are being formed on the intermediate transfer member 9, that is, when the intermediate transfer member 9 are rotated a plurality of times, the transfer belt 10 is positioned below and is spaced apart from the intermediate transfer member 9 so that the images may not be disturbed.

After the four color toners have formed images on the intermediate transfer member 9, the transfer belt 10 is elevated by a cam member (not shown) in timed relationship with the transfer of the color images onto the transfer material 2 so that the conveyance route of the transfer material 2 may overlie as indicated by dot-and-dash line, and is urged against the intermediate transfer member 9 with predetermined pressure through the transfer material 2. At the same time, a bias is applied to the transfer belt 10 to transfer the toner images on the intermediate transfer member 9 onto the transfer material 2. Since the intermediate transfer member 9 and the transfer belt 10 are driven by respective driving mechanisms, the transfer material 2 sandwiched therebetween is subjected to the transferring step and at the same time, is conveyed leftwardly as viewed in FIG. 1 at a predetermined speed, and is conveyed toward a fixating portion 25 which is the next step.

(9) Fixating Portion

The fixating portion 25 fixates the toner image formed on the transfer material 2 by the toner images formed by the rotatable developing devices 20Y, 20M, 20C and the black developing device 21B being transferred onto the transfer material 2 through the intermediate transfer member 9, and as shown in FIG. 1. It comprises a fixating roller 26 for applying heat to the transfer material 2, and a pressing roller 27 for urging the transfer material 2 against the fixating roller 26. The fixating roller 26 and the pressing roller 27 are hollow rollers having heaters 28 and 29 therein respectively, and are designed to convey the transfer material 2 when they are rotatively driven. That is, the transfer material 2 holding the toner image thereon is conveyed by the fixating roller 26 and the pressing roller 27 and has heat and pressure applied hereto. As the result, the toner image is fixated on the transfer material 2.

(10) Image Forming Operation

The operation of effecting image formation by the apparatus constructed as described above will hereinafter be described with reference to FIG. 1.

First, the sheet feeding roller 3 is rotated to separate a transfer material 2 in the cassette 1 and convey it to the register roller 8. On the other hand, the photosensitive drum 15 and the intermediate transfer member 9 are rotated in the directions of arrows, and the peripheral surface of the photosensitive drum 15 is uniformly charged by the charging means 17. Also, the light application of a yellow image is effected by the scanner portion 30 to thereby form a yellow latent image on the photosensitive drum 15.

Simultaneously with the formation of this latent image, the yellow developing device 20Y is driven and a voltage of the same polarity as the charging polarity of the photosensitive drum 15 and substantially of the same potential as that of the photosensitive drum is applied so that the yellow toner may adhere to the latent image on the photosensitive drum 15 to thereby effect yellow development. And a voltage opposite in polarity to the above-mentioned toner is applied to the intermediate transfer member 9 to thereby transfer the yellow toner on the photosensitive drum 15 onto the intermediate transfer member 9.

When the transfer of the yellow-toner onto the intermediate transfer member 9 is terminated as described above, the developing rotary 23 is rotated and the next magenta developing device 20M is rotatively moved and is positioned at a position opposed to the photosensitive drum 15, and the magenta toner is developed and transferred like the yellow toner. Then, the formation and development of cyan and black latent images and the transfer of these toners onto the intermediate transfer member 9 are effected, whereby color images of four kinds of toners, i.e. to form yellow, magenta, cyan and black toners on the peripheral surface of the intermediate transfer member 9.

After the color images by the toners are formed on the peripheral surface of the intermediate transfer member 9, the transfer material 2 standing by at the register roller 8 is conveyed and the transfer material 2 is urged against the intermediate transfer member 9 by the transfer belt 10. At the same time, a bias opposite in polarity to the toners is applied to the transfer belt 10 to transfer the color image by the toners on the intermediate transfer member 9 onto the transfer material 2. The transfer material 2 which has been subjected to the transferring step is separated from the intermediate transfer member 9 and conveyed to the fixating portion 25 to effect the fixation of the toners. Then, the transfer material is discharged onto the discharge tray 37 on the upper portion of the printer body with the image bearing surface thereof facing downwardly, through three pairs of discharge rollers 34, 35 and 36, thus completing the image forming operation.

Figure 3:
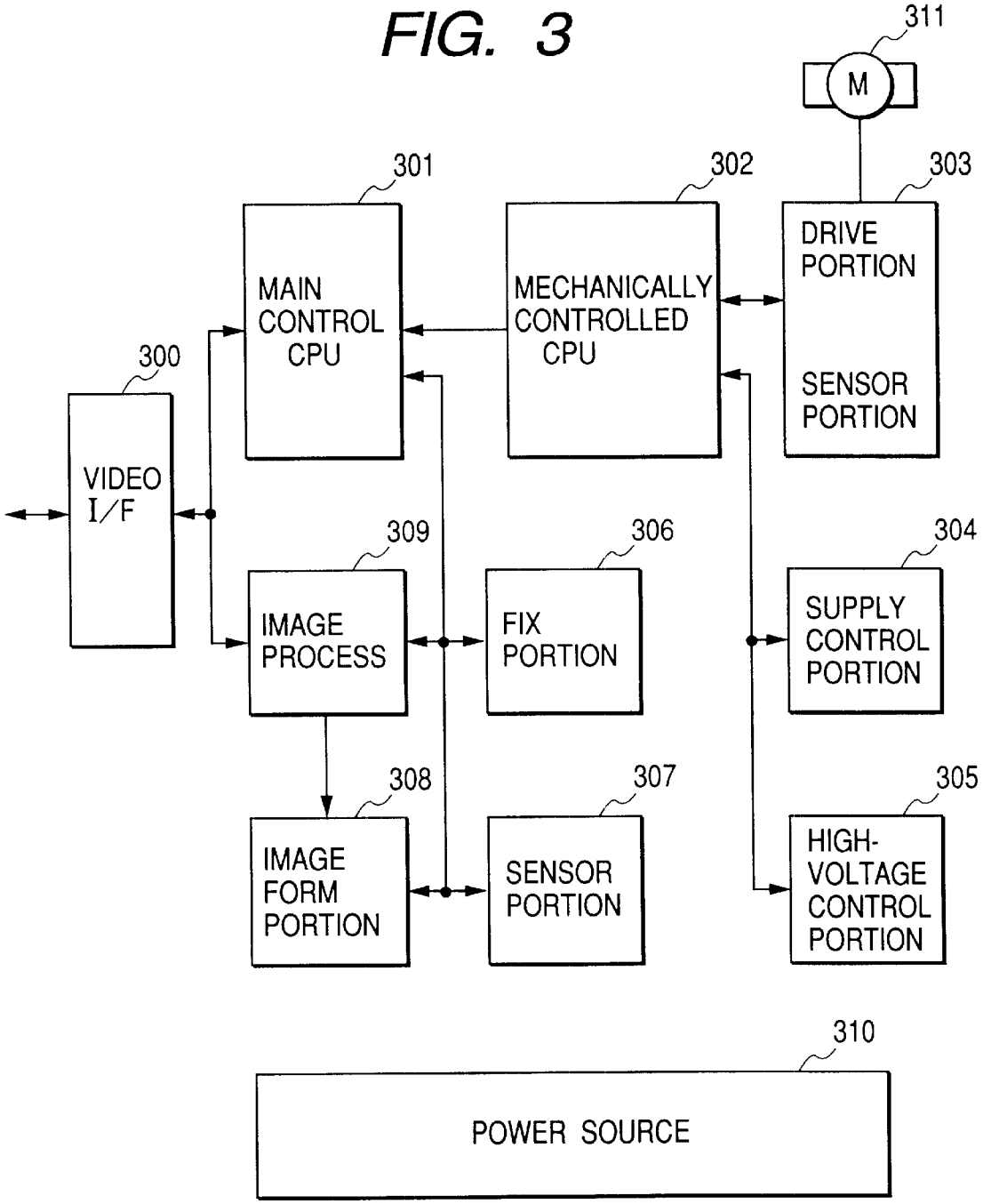
FIG. 3 is a schematic system diagram of the engine portion of the image forming apparatus of FIG. 1.

FIG. 3 is a schematic system diagram of the engine portion of the image forming apparatus of FIG. 1. The reference numeral 300 designates a video interface (video I/F) which is an interface portion with an external controller for controlling the engine and is connected to a main control portion 301 and an image processing GA 309. The main control portion 301 is connected to a fixating portion 306, a sensor portion 307, the image processing GA 309, an image forming portion 308 and a mechanically controlled CPU 302. The sensor portion 307 comprises a humidity sensor, a toner remaining amount detecting sensor, etc. The image processing GA 309 effects image processing such as γ correction on image data received from the interface 300. The image forming portion 308 effects laser outputting and the image outputting of a scanner motor or the like. The mechanically controlled CPU 302 has the function as a sub-CPU. The mechanically controlled CPU 302 controls a motor such as a motor 41 for the cleaning means 38 which will be described later, a drive portion such as a clutch, a sensor portion 303, a supply control portion 304 and a high-voltage control portion 305. The reference numeral 310 denotes a power source portion for supplying electric power to the whole of the image forming apparatus of FIG. 1.

Figure 4A:
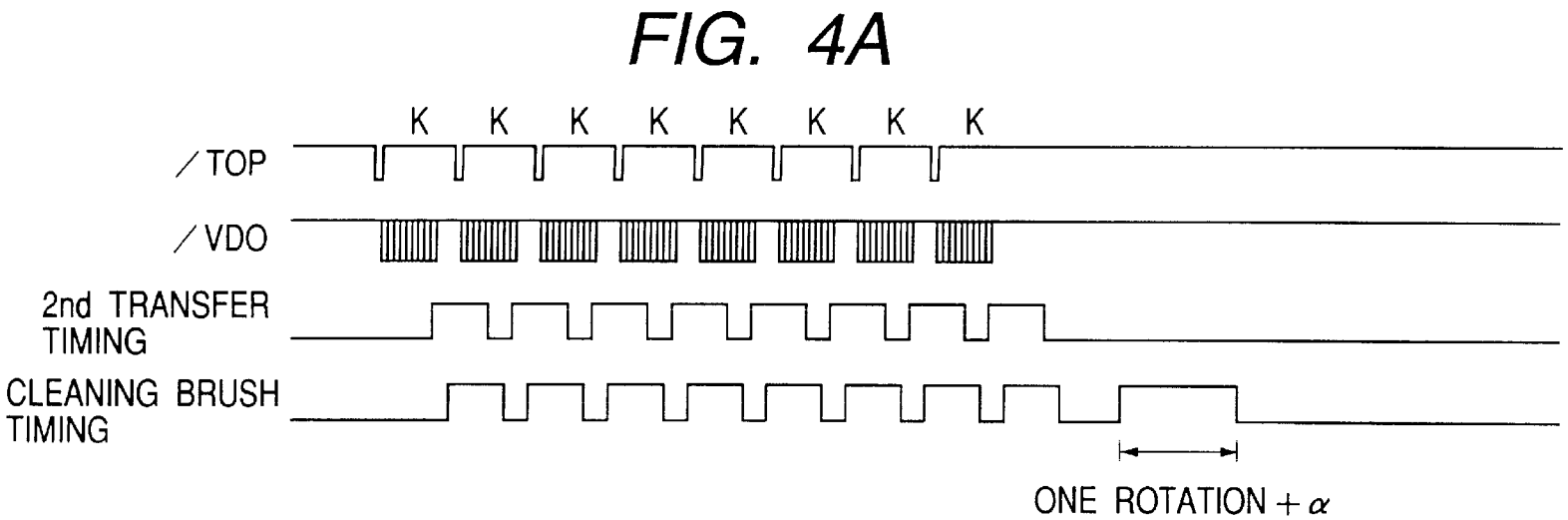
FIG. 4A is a timing chart of the cleaning process in the case of continuous printing in the monochromatic mode.
Figure 4B:
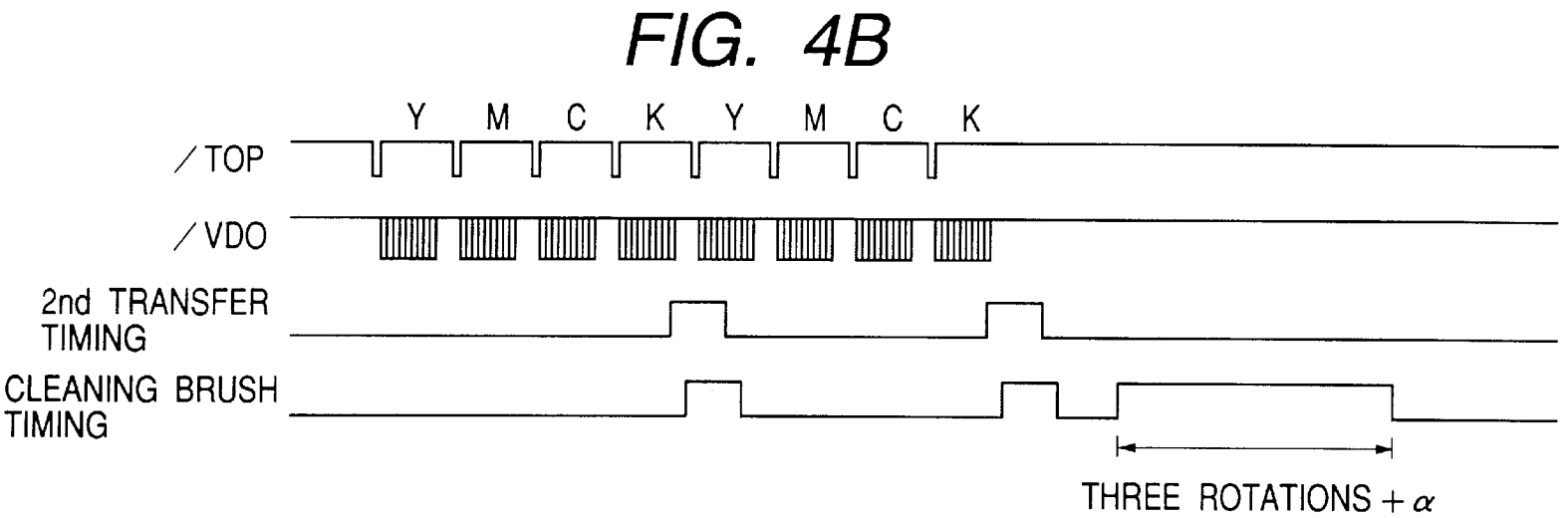
FIG. 4B is a timing chart of the cleaning process in the case of continuous printing in the full color mode.

FIG. 4A is a timing chart of cleaning in the case of continuous printing in the monochromatic mode, and FIG. 4B is a timing chart of cleaning in the case of continuous printing in the full color mode. In these figures, ITOP is an image synchronized signal in the sub-scanning direction, and when this signal is transmitted to a controller through the video interface 300 of FIG. 2, the controller outputs video data IVDO in synchronism with this signal. In these figures, the timing of second transfer and the drive timing of the cleaning brush are shown together.

It will be seen that in the case of the monochromatic mode (FIG. 4A), as compared with the case of the full color mode (FIG. 4B), the cleaning time after continuous printing is short. This is because in the case of the full color mode, the formation of the four colors Y, M, C and K on the intermediate transfer member 9 is completed after four full rotations, Then, the color images are collectively secondarily transferred onto the transfer material 2 by the transfer belt 10, and therefore during the rotation for Y, M and C, the cleaning brush 39 is spaced apart from the intermediate transfer member 9 and cleaning is not executed. As compared with this, in the case of the monochromatic mode, the cleaning by the cleaning brush 39 is executed during each one full rotation of the intermediate transfer member 9, and therefore the untransferred toner accumulated on the intermediate transfer member 9 is small in quantity and the cleaning time may be short.

Figure 5:
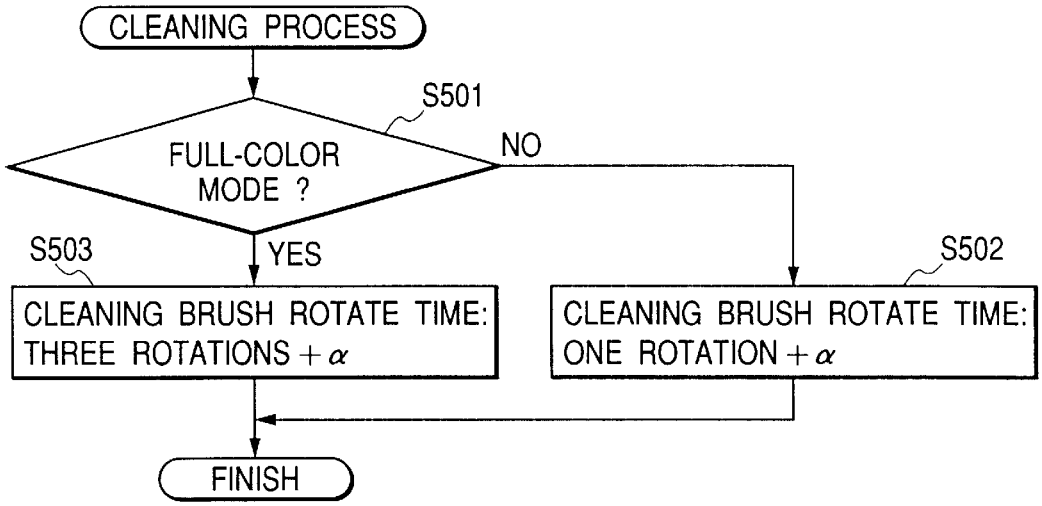
FIG. 5 is a flow chart of the cleaning process after the continuous printing in the monochromatic mode and the full color mode in accordance with the timing charts of FIGS. 4A and 4B.

FIG. 5 is a flow chart of the cleaning process after the continuous printing in the monochromatic mode and the full color mode in accordance with the timing charts of FIGS. 4A and 4B. The process of FIG. 5 is executed by the mechanically controlled CPU 302.

First, at a step S501, whether the printing mode is the continuous printing in the full color mode is discriminated. If at the step S501, the printing mode is not the continuous printing in the full color mode, the cleaning brush 39 is rotated for (one rotation+α) time (step S502), and this process is terminated. Here, (one rotation+α) means the time for which the intermediate transfer member 9 is rotated by one rotation+α (the same applies hereinafter). If at the step S501, the printing mode is the continuous printing in the full color mode, the cleaning brush 39 is rotated for (three rotations+α) time (step S503), and this process is terminated.

According to this first embodiment, when the full color mode and the monochromatic mode are not mixedly present during continuous printing, the cleaning time during the printing in the monochromatic mode is not set to a long cleaning time corresponding to the printing time in the full color mode, but can be determined with the conditions of actual use taken into account.

Second Embodiment

An image forming apparatus according to a second embodiment of the present invention will hereinafter be described with reference to FIGS. 6 and 7.

The image forming apparatus according to the first embodiment is of a type which selects the amount of cleaning from among the fixed values when the full color mode and the monochromatic mode are not mixedly present during continuous printing, whereas the second embodiment differs from the first embodiment in that it is of a type which uses a variable value as the cleaning time when the full color mode and the monochromatic mode are mixedly present during continuous printing. The basic construction of the image forming apparatus according to the second embodiment of the present invention is the same as the construction of the first embodiment described with reference to FIGS. 1 to 3 and need not be described.

Figure 6:
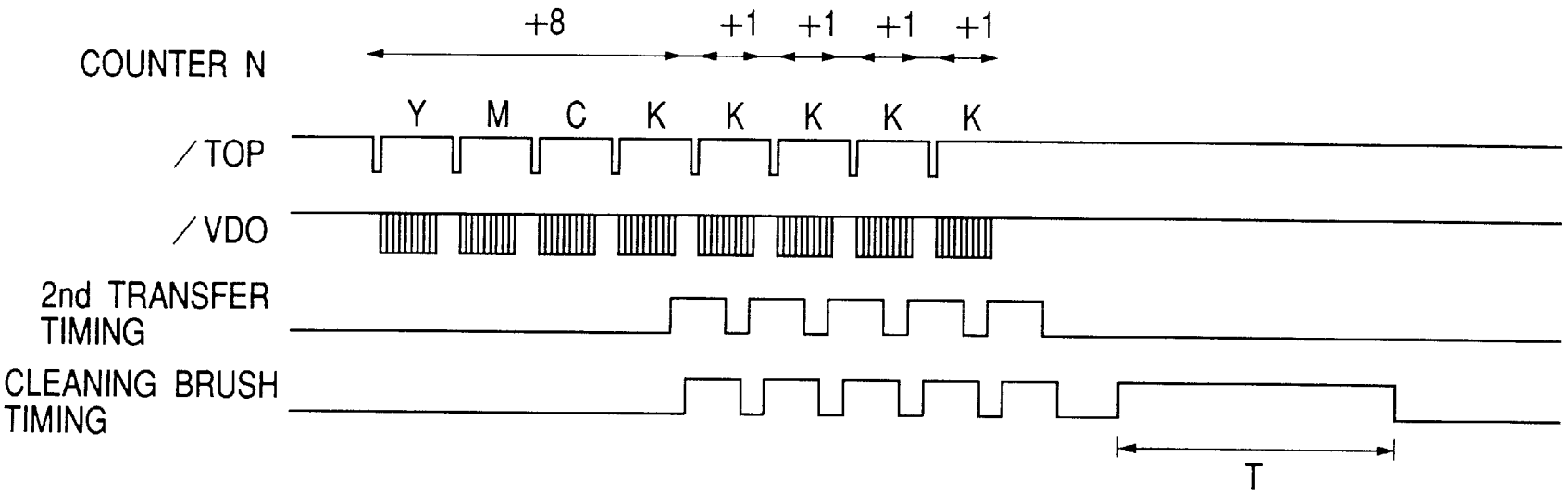
FIG. 6 is a timing chart of the cleaning process in an image forming apparatus according to a second embodiment of the present invention.
Figure 7:
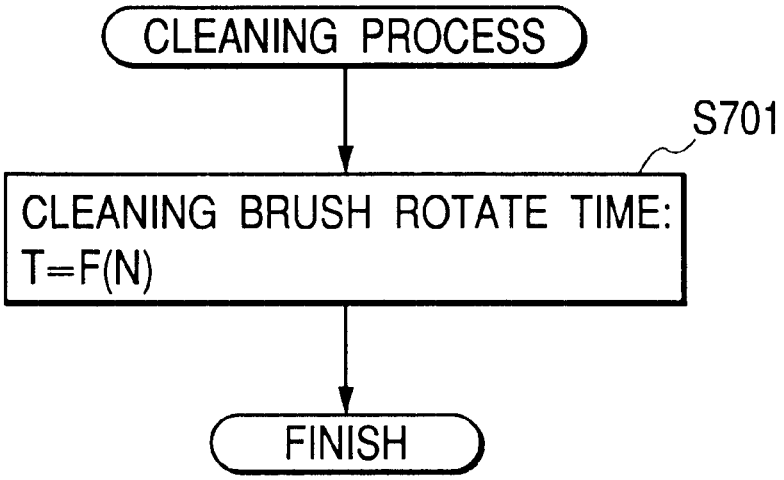
FIG. 7 is a flow chart of the cleaning process executed at the last of the continuous printing in the case of FIG. 6.

Specifically, in FIG. 6, a counter N is used to add data weighted to the color mode. The counter N counts +8 as a count value when the color mode is the full color mode, and counts +1 when the color mode is the monochromatic mode. After the termination of continuous printing, a cleaning time T proportional to the count value added by the counter N is found. In the case of FIG. 6, the printing by the full color mode is one time and the printing by the monochromatic mode is four times, and therefore, the added value by the counter N is $8\times1+1\times4=12$. In FIG. 7, the rotation time T of the cleaning brush 39 is calculated from a function F(N) of the count value of the counter N (step S701). After the termination of this process, the count value of the counter N is cleared.

According to this second embodiment, when the full color mode printing and the monochromatic mode printing are mixedly present during continuous printing, the cleaning time can be determined with the conditions of actual use of the printing time in the monochromatic mode and the printing time in the full color mode taken into account.

Third Embodiment

An image forming apparatus according to a third embodiment of the present invention will hereinafter be described with reference to FIGS. 8 and 9.

The above-described second embodiment is of a type in which when the full color mode and the monochromatic mode are mixedly present during continuous printing, the full color mode and the monochromatic mode are weighted and the cleaning time is determined on the basis of the count values thereof, and cleaning is executed after the continuous printing. Whereas, the third embodiment differs from the second embodiment in that when the value added during continuous printing exceeds a predetermined number, it is judged that the toner remaining on the intermediate transfer member 9 is accumulated as much as it will affect the next image, so that the continuous printing is interrupted and the cleaning process is executed. The construction of the image forming apparatus according to the third embodiment of the present invention is the same as the construction of the first embodiment described with reference to FIGS. 1 to 3 and need not be described.

Figure 8:
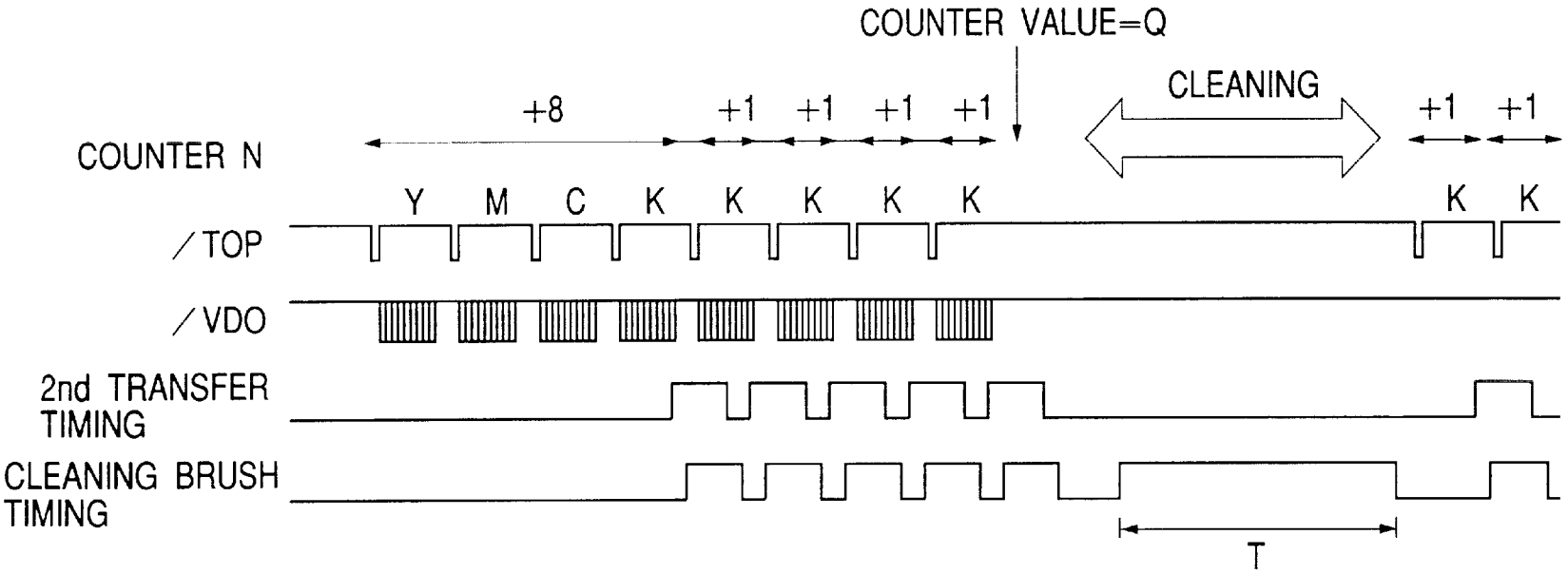
FIG. 8 is a timing chart of the cleaning process in an image forming apparatus according to a third embodiment of the present invention.

In FIG. 8, when the full color mode and the monochromatic mode are mixedly present during continuous printing, data weighted to the color mode is added. A counter N is used to add this data weighted to the color mode. The counter N counts +8 as a count value when the color mode is the full color mode, and counts +1 when the color mode is the monochromatic mode. When the value added during the continuous printing exceeds a predetermined number, it is judged that the toner remaining on the intermediate transfer member 9 is accumulated as much as it will affect the next image, so that the continuous printing is interrupted and the cleaning process is executed.

Figure 9:
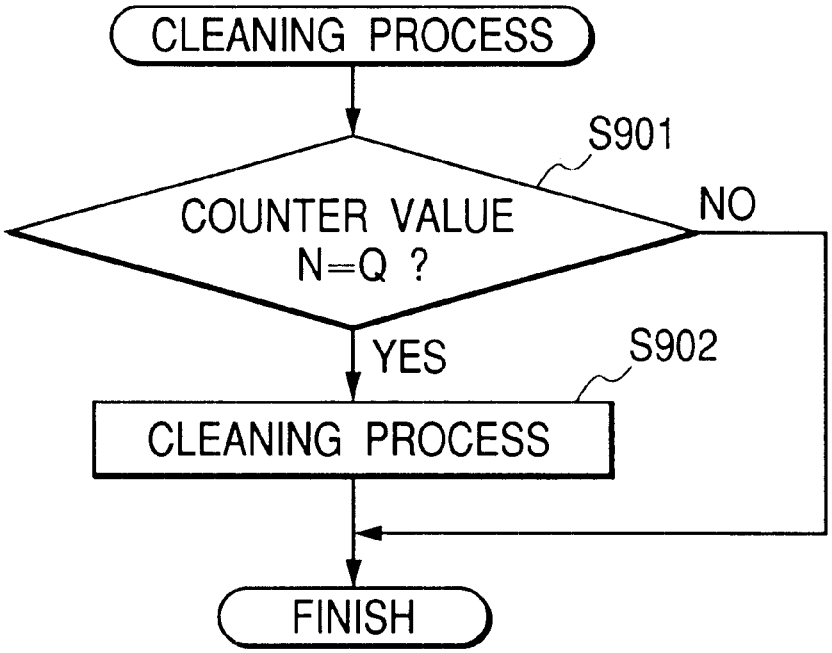
FIG. 9 is a flow chart of the cleaning process executed during the continuous printing by the timing chart of FIG. 8.

In FIG. 9, first at a step S901, whether the value of the counter N has reached a predetermined value Q is judged. If at the step S901, the value of the counter N has reached the predetermined value Q, the cleaning motor 39 is driven for a predetermined time T to effect the cleaning process (step S902), thus terminating this process. If at the step S901, the value of the counter N has not reached the predetermined value Q, this process is immediately terminated. After the termination of this process, the count value of the counter N is cleared. After the termination of cleaning, the interrupted continuous printing is resumed.

According to this third embodiment, when the full color mode and the monochromatic mode are mixedly present during continuous printing, the cleaning time can be determined with the conditions of actual use of the printing time in the monochromatic mode and the printing time in the full color mode taken into account. In addition, the toner remaining on the intermediate transfer member 9 can be prevented from being accumulated as much as it will affect the next image.

As described above in detail, according to the electrophotographic type color image forming apparatus and the electrophotographic type color image forming method in accordance with the present invention, the determining means can determine the execution time of the cleaning process for the image bearing member on the basis of the kind of the color mode detected by the detecting means. Also, when the full color mode and the monochromatic mode are not mixedly present during continuous printing, the cleaning time during the printing in the monochromatic mode is not set to a long cleaning time corresponding to the printing in the full color mode, but can be determined with the conditions of actual use taken into account. Further, when the full color mode and the monochromatic mode are mixedly present during continuous printing, the cleaning time can be determined with the conditions of actual use of the printing time in the monochromatic mode and the printing time in the full color mode taken into account. Furthermore, when the fill color mode and the monochromatic mode are mixedly present during continuous printing, the cleaning time can be determined with the conditions of actual use of the printing time in the monochromatic mode and the printing time in the full color mode taken into account and in addition, the toner remaining on the image bearing member can be removed thereby preventing toner from accumulating and affecting the next image.

What is claimed is:

1. A color image forming apparatus for forming images in a monochromatic mode and a full color mode on an image bearing member by an electrophotographic system, comprising:

means for forming a toner image in a predetermined color mode on the image bearing member;

transfer means for transferring the toner image onto a transfer material;

cleaning means for removing any toner remaining on said image bearing member after the transfer operation;

color mode detecting means for detecting a kind of selected color mode; and determining means for determining a time for which said cleaning means cleans the image bearing member, on the basis of the detected kind of color mode;

wherein the time of said cleaning means operates based on a specific weighting for each of the monochromatic mode and the full color mode, and wherein said color mode detecting means determines the time based on an added value representing a total weighting of each mode.

2. A color image forming apparatus according to claim 1, wherein said image bearing member is an intermediate transfer member onto which the toner image formed on an electrophotographic photosensitive member is transferred, and which is used to further transfer said transferred toner image onto the transfer material.

3. A color image forming apparatus for forming images in a monochromatic mode and a full color mode on an image bearing member by an electrophotographic system, comprising:

a developing device for forming a toner image in a predetermined color mode on the image bearing member;

a transfer electrode for applying a bias voltage opposite in polarity to the toner image to transfer the toner image to a transfer material;

a cleaning device fictionally sliding on the image bearing member to remove any toner remaining on said image bearing member after the transfer operation;

a color mode detecting circuit for detecting the kind of the selected color mode; and a determining circuit for determining a time for which said cleaning device cleans the image bearing member on the basis of the detected kind of the color mode;

wherein the time of said cleaning device operates based on a specific weighting for each of the monochromatic mode and the full color mode, and wherein said color mode detecting circuit determines the time based on an added value representing a total weighting of each mode.

4. A color image forming apparatus according to claim 3, wherein said image bearing member is an intermediate transfer member onto which the toner image formed on an electrophotographic photosensitive member is transferred, and which is used to further transfer said transfer red toner image onto the sheet-like transfer material.

5. A color image forming method for forming images in a monochromatic mode and a full color mode on an image bearing member by an electrophotographic system, comprising step of:

a step for forming a toner image in a predetermined color mode on the image bearing member;

a step for transferring the toner image onto a transfer material;

a step for removing any toner remaining on the image bearing member after the transfer operation;

a detecting step for detecting the kind of the selected color mode; and a step for determining the time for which a cleaning means cleans the image bearing member, on the basis of the detected kind of the color mode;

wherein the time of the cleaning in said cleaning step operates based on a specific weighting for each of the monochromatic mode and the full color mode, and wherein the time in said cleaning step is determined on the basis of an added value representing a total weighting of each mode.

6. A color image forming method according to claim 5, wherein said image bearing member used in said toner image forming means is an intermediate transfer member onto which the toner image formed on an electrophotographic photosensitive member is transferred, and which is used to further transfer said transferred toner image onto the transfer material.

7. A color image forming apparatus for forming images in a monochromatic mode and a full color mode on an image bearing member by an electrophotographic system, comprising:

means for forming a toner image in a predetermined color mode on the image bearing member;

transfer means for transferring the toner image onto a transfer material;

cleaning means for removing any toner remaining on said image bearing member after the transfer operation;

color mode detecting means for detecting a kind of selected color mode; and determining means for determining a time for which said cleaning means cleans the image bearing member, on the basis of the detected kind of color mode;

wherein the time of said cleaning means operates based on a specific weighting for each of the monochromatic mode and the full color mode, and wherein said determining means determines the time based on an added value representing a total weighting of each mode, and, if said determining means determines that the weighting exceeds a predetermined value, said cleaning means is operated.

8. A color image forming apparatus for forming images in a monochromatic mode and a full color mode on an image bearing member by an electrophotographic system, comprising:

a developing device for forming a toner image in a predetermined color mode on the image bearing member;

a transfer electrode for applying a bias voltage opposite in polarity to the toner image to transfer the toner image to a transfer material;

a cleaning device frictionally sliding on the image bearing member to remove any toner remaining on said image bearing member after the transfer operation;

a color mode detecting circuit for detecting the kind of the selected color mode; and a determining circuit for determining a time for which said cleaning device cleans the image bearing member on the basis of the detected kind of the color mode;

wherein the time of said cleaning device operates based on a specific weighting for each of the monochromatic mode and the full color mode, and wherein said determining circuit determines the time based on an added value representing a total weighting of each mode, and, if said determining circuit determines that the total weighting exceeds a predetermined value, said cleaning means is operated.

9. A color image forming apparatus according to claims 7 or 8, wherein said image bearing member is an intermediate transfer member onto which the toner image formed on the electrophotographic photosensitive member is transferred, and which is used to further transfer said transferred toner image onto the transfer material.

10. A color image forming method for forming images in a monochromatic mode and a full color mode on an image bearing member by an electrophotographic system, comprising the steps of:

a step for forming a toner image in a predetermined color mode on the image bearing member;

a step for transferring the toner image onto a transfer material;

a step for removing any toner remaining on the image bearing member after the transfer operation;

a detecting step for detecting the kind of the selected color mode; and a step for determining the time for which the cleaning means cleans the image bearing member, on the basis of the detected kind of the color mode;

wherein the time of said cleaning in said cleaning step operates based on a specific weighting for each of the monochromatic mode and the full color mode, and wherein the time in said cleaning step is determined on the basis of an added value representing a total weighting of each mode, and, if it is detected that a total weighting exceeds a predetermined value, said cleaning step is executed.

11. A color image forming method according to claim 10, wherein said image bearing member is an intermediate transfer member on which the toner image formed on an electrophotographic photosensitive member is transferred, and which is used to further transfer said transferred toner image onto the transfer material.

12. An image forming apparatus having a continuous printing mode for forming images continuously in a monochromatic mode and in a full color mode on an image bearing member by an electrophotographic system, including:

toner image forming means for forming a toner image on said image bearing member;

transferring means for transferring said toner image onto a transfer material;

cleaning means for removing any toner remaining on said image bearing member after said toner image is transferred onto said transfer material by said transferring means, and said cleaning means further removing any toner remaining on said image bearing member after said continuous printing mode is completed;

color mode detecting means for detecting a kind of color mode;

determining means for determining a time for which said cleaning means further removes any toner remaining on said image bering member after said continuous printing mode is completed; and a counter for counting a first value weighted on said monochromatic mode and a second value weighted on said full color mode to calculate a sum of said first value and said second value in said continuous printing mode, said first value being smaller than said second value;

wherein said determined means determines said time in accordance with said sum.

13. An image forming apparatus according to claim 12, wherein when said sum is not less than a predetermined value, said continuous printing mode is ceased so that said cleaning means removes any toner remaining on said image bearing member, and thereafter said continuous printing mode is restarted.

14. An image forming apparatus according to claims 12 or 13, wherein said image bearing member is an intermediate transfer member onto which the toner image formed on an electrophotographic photosensitive member is transferred, and which is used to further transfer said transferred toner image onto the transfer material.

15. An image forming apparatus comprising:

an image bearing member;

an intermediate transfer member to which a toner image is transferred from said image bearing member, wherein the toner image is transferred from said intermediate transfer member to a transfer material;

cleaning means for cleaning off toner remaining on said intermediate transfer member;

detecting means for detecting a color mode of an image to be formed on the transfer material; and control means for controlling a time for cleaning said intermediate transfer member with said cleaning means, wherein when images of different color modes are continuously formed on a plurality of transfer materials, said control means controls the time for cleaning after a completion of a continuous image-formation, based on output, in course of the continuous image-formation, of said detecting means.

16. An image forming apparatus according to claim 15, further comprising cleaning means for said image bearing member which cleans off the toner transferred from said intermediate transfer member to said image bearing member.

17. An image forming apparatus according to claim 16, wherein said cleaning means for said image bearing member has a blade which contacts said image bearing member.

* * * * *

UNITED STATES PATENT AND TRADEMARK OFFICE

CERTIFICATE OF CORRECTION

PATENT NO. : 6,470,154 B1
DATED : October 22, 2002
INVENTOR(S) : Hayato Shinohara It is certified that error appears in the above-identified patent and that said Letters Patent is hereby corrected as shown below:

Column 4,
Line 3, “fortion.” should read -- portion. --; and
Line 17, “successively,” should read -- successively formed, --.

Column 5,
Line 44, “are” should read -- is --.

Column 6,
Line 13, “hereto” should read -- thereto --; and
Line 48, “toners, i.e. to form” should read -- toners are formed, so that there are --.

Column 10,
Line 48, “transfer red” should read -- transferred --; and
Line 53, “step” should read -- the steps --.

Signed and Sealed this

Fifteenth Day of July, 2003

JAMES E. ROGAN
*Director of the United States Patent and Trademark Office*